US006032655A

United States Patent [19]

Kavonius

[11] Patent Number: 6,032,655

[45] Date of Patent: Mar. 7, 2000

[54] COMBUSTION ENHANCER

[76] Inventor: Eino John Kavonius, 516 Meadow Ln., Woodbury, Minn. 55125

[21] Appl. No.: 09/088,504

[22] Filed: Jun. 1, 1998

[51] Int. Cl.[7] ..... F02M 33/00

[52] U.S. Cl. ..... 123/538

[58] Field of Search ..... 123/536, 537, 123/538

[56] References Cited

U.S. PATENT DOCUMENTS

| | | | |
|---|---|---|---|
| 4,130,099 | 12/1978 | Ferguson . | |
| 5,154,153 | 10/1992 | MacGregor | 123/538 |
| 5,482,024 | 1/1996 | Elliott . | |
| 5,524,594 | 6/1996 | D'Alessandro . | |
| 5,526,401 | 7/1996 | Burns . | |
| 5,533,490 | 7/1996 | Pascall . | |
| 5,673,674 | 10/1997 | Monteiro Vieira . | |
| 5,730,109 | 3/1998 | Nozawa | 123/538 |
| 5,816,227 | 10/1998 | Cronk . | |
| 5,871,000 | 2/1999 | Ratner | 123/538 |
| 5,881,702 | 3/1999 | Arkfeld | 123/538 |

OTHER PUBLICATIONS

Brochure, Vitalize your Engine. No date given.

*Primary Examiner*—Marguerite McMahon
*Attorney, Agent, or Firm*—Kinney & Lange, P.A.

[57] ABSTRACT

A device for enhancing the combustion of fuel in an internal combustion engine. The combustion enhancer, which is used inside the fuel line of a vehicle, comprises a metallic double spring. The combustion enhancer swirls the fuel and also imparts a charge to the fuel, thus promoting more complete combustion.

2 Claims, 1 Drawing Sheet

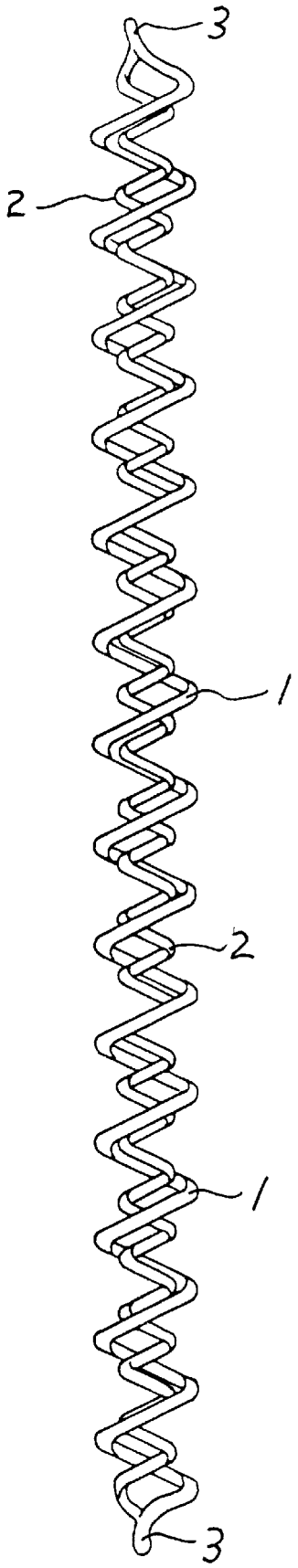
3
2
1
2
1
3

COMBUSTION ENHANCER

BACKGROUND OF THE INVENTION

The field of the invention is devices placed in the fuel line of a vehicle to enhance combustion in an internal combustion engine.

In a typical automobile engine, only about sixty percent of the gasoline is burned in the engine. The rest is emitted into the air via the tail pipe or catalytic converter, in the form of carbon monoxide and hydrocarbons. This incomplete combustion wastes fuel and contributes to air pollution.

Various prior art devices have been tried in order to increase combustion. These include a rubber disc in the venturi to spray gasoline, metal dividers to agitate the gasoline, metallic catalysts added to the gasoline, and magnets to impart a charge to the gasoline. None of these devices works very well.

SUMMARY OF THE INVENTION

The invention is a combustion enhancer comprising two springs which are attached to each other at either end, forming a double spring with an outer coil and an inner coil. The springs are made of metal, preferably silver. The springs are coiled in the same direction, causing the gasoline to swirl therethrough, and the springs also conduct electricity and thereby provide a charge to the gasoline, thus increasing combustion.

An advantage of the invention is that fuel is more completely burned, thus increasing the vehicle's mileage per gallon significantly, and also providing some increase in power.

Another advantage of the invention is that, as a result of more complete combustion, carbon monoxide and hydrocarbons emissions are almost completely eliminated, thus reducing air pollution.

Another advantage is that more complete combustion prevents the buildup of carbon in the engine, thus prolonging engine life.

DESCRIPTION OF THE DRAWING

The FIGURE is a front view.

DESCRIPTION OF THE PREFERRED EMBODIMENT OF THE INVENTION

The combustion enhancer is a double spring (windings of silver metal to a spring-like shape) comprising a first spring 1 and second string 2. Springs 1 and 2 are each formed in a generally linear zig-zag pattern that intertwine over and under each other such that the first (larger) spring 1 is the outer coil and the second (smaller) spring 2 is the inner coil. At either end of springs 1 and 2, springs 1 and 2 are joined together by soldered end connections 3.

Springs 1 and 2 are made of a metal which conducts electricity. Silver is the preferred material, since it is the best conductor of electricity and it also resists oxidation and does not corrode. Copper is a possible alternative; it conducts electricity well but not as well as silver. The silver will usually be alloyed with platinum, since platinum acts as a catalyst in the fuel line. A two inch section of platinum is soldered onto one end of the outer silver spring 1. The soldered end 3 is silver at the other end of the springs 1 and 2. The platinum section can be at either end. It is also possible to make the springs 1 and 2 completely silver, with silver solder at both end connections 3.

The combustion enhancer is usually one-fourth to five-sixteenths of an inch wide (outside diameter) for use in automobiles. Smaller versions may be used in tractors. The prototype is about fourteen inches long. It is expected that production models will be somewhat shorter.

The combustion enhancer is installed in the fuel line of an automobile, specifically, in the flex line, which is a line about fifteen to sixteen inches long which is positioned before the fuel injector. The combustion enhancer is not fastened to the flex line and therefore it can be installed easily without damaging any original equipment. The combustion enhancer is held in position by the walls of the flex line; it floats in the gasoline but does not move.

The passage of the fuel through the combustion enhancer conditions the fuel for efficient combustion by creating a charge and a change in molecular size. The gasoline flows in the sane direction around springs 1 and 2, and is swirled, thus creating turbulence in the gasoline. The silver springs 1 and 2, which have a large surface area, conduct electricity, creating a positive charge in the gasoline, for efficient combustion. The gasoline molecules become smaller as the gasoline is charged and swirled.

The invention has been tested in three automobiles over a two year period, covering over thirty-five thousand miles of city and highway driving. Cars equipped with this device averaged thirty-four to thirty-six miles per gallon in highway driving, an improvement in mileage of over twenty percent. Emissions of carbon monoxide and hydrocarbons were reduced to nearly zero.

I claim:

1. A device for enhancing combustion of fuel in internal combustion engines, said device comprising:

a double spring, positionable in a fuel line, the spring comprising a first outer spring and a second inner spring, said first and second springs being attached to each other at both of their respective ends, said double spring being comprised of a material which conducts electricity.

2. The device of claim 1 wherein said double spring is comprised of silver material.

* * * * *